US009624659B2

(12) United States Patent
Hohmann, Jr.

(10) Patent No.: US 9,624,659 B2
(45) **Date of Patent: *Apr. 18, 2017**

(54) THERMALLY COATED WALL ANCHOR AND ANCHORING SYSTEMS WITH IN-CAVITY THERMAL BREAKS FOR CAVITY WALLS

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 33 days.

This patent is subject to a terminal disclaimer.

(21) Appl. No.: 14/719,655

(22) Filed: May 22, 2015

(65) Prior Publication Data

US 2015/0252560 A1 Sep. 10, 2015

Related U.S. Application Data

(63) Continuation of application No. 13/786,982, filed on Mar. 6, 2013, now Pat. No. 9,038,351.

(51) Int. Cl.
*E04B 1/41* (2006.01)

(52) U.S. Cl.
CPC ..... *E04B 1/4185* (2013.01); *E04B 1/4178* (2013.01)

(58) Field of Classification Search
CPC ..... E04B 1/4178; E04B 1/4185; E04C 2002/048; E04C 5/01; E04C 5/015; E04C 5/017
See application file for complete search history.

(56) References Cited

U.S. PATENT DOCUMENTS 819,869 A 5/1906 Dunlap
903,000 A 11/1908 Priest
(Continued)

FOREIGN PATENT DOCUMENTS

CH 279209 3/1952
EP 0 199 595 B1 3/1995
(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Jessica Laux
(74) *Attorney, Agent, or Firm* — Senniger Powers LLP

(57) ABSTRACT

Thermally-isolating wall anchors and reinforcement devices and anchoring systems employing the same are disclosed for use in masonry cavity walls. A thermally-isolating coating is applied to the wall anchor, which is interconnected with a wire formative veneer tie. The thermally-isolating coating is selected from a distinct grouping of materials, that are applied using a specific variety of methods, in one or more layers and cured and cross-linked to provide high-strength adhesion. The thermally-coated wall anchors provide an in-cavity thermal break that severs the thermal threads running throughout the cavity wall structure, reducing the U- and K-values of the anchoring system by thermally-isolating the metal components.

20 Claims, 5 Drawing Sheets

(56) References Cited

U.S. PATENT DOCUMENTS 1,014,157 A 1/1912 Lewen
1,170,419 A 2/1916 Coon et al.
RE15,979 E 1/1925 Schaefer et al.
1,794,684 A 3/1931 Handel
1,936,223 A 11/1933 Awbrey
1,988,124 A 1/1935 Johnson
2,058,148 A 10/1936 Hard
2,097,821 A 11/1937 Mathers
2,280,647 A 4/1942 Hawes
2,300,181 A 10/1942 Spaight
2,343,764 A 3/1944 Fuller
2,403,566 A 7/1946 Thorp et al.
2,413,772 A 1/1947 Morehouse
2,605,867 A 8/1952 Goodwin
2,780,936 A 2/1957 Hillberg
2,898,758 A 8/1959 Henrickson
2,909,054 A 10/1959 Phillips
2,929,238 A 3/1960 Kaye
2,966,705 A 1/1961 Massey
2,999,571 A 9/1961 Huber
3,030,670 A 4/1962 Bigelow
3,088,361 A 5/1963 Hallock
3,114,220 A 12/1963 Maddox et al.
3,121,978 A 2/1964 Reiland
3,183,628 A 5/1965 Smith
3,254,736 A 6/1966 Gass
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,440,922 A 4/1969 Cohen
3,478,409 A 11/1969 Votaw et al.
3,478,480 A 11/1969 Swenson
3,529,508 A 9/1970 Cooksey
3,563,131 A 2/1971 Ridley, Sr.
3,568,389 A 3/1971 Gulow
3,640,043 A 2/1972 Querfeld et al.
3,803,972 A 4/1974 Deutsher
3,897,712 A 8/1975 Black
3,911,783 A 10/1975 Gapp et al.
3,925,996 A 12/1975 Wiggill
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,281,494 A 8/1981 Weinar
4,305,239 A 12/1981 Geraghty
4,373,314 A 2/1983 Allan
4,382,416 A 5/1983 Kellogg-Smith
4,410,760 A 10/1983 Cole
4,424,745 A 1/1984 Magorian et al.
4,438,611 A 3/1984 Bryant
4,460,300 A 7/1984 Bettini et al.
4,473,984 A 10/1984 Lopez
4,482,368 A 11/1984 Roberts
4,571,909 A 2/1986 Berghuis et al.
4,596,102 A 6/1986 Catani et al.
4,598,518 A 7/1986 Hohmann
4,606,163 A 8/1986 Catani
4,622,796 A 11/1986 Aziz et al.
4,628,657 A 12/1986 Ermer et al.
4,636,125 A 1/1987 Burgard
4,640,848 A 2/1987 Cerdan-Diaz et al.
4,660,342 A 4/1987 Salisbury
4,688,363 A 8/1987 Sweeney et al.
4,703,604 A 11/1987 Muller
4,708,551 A 11/1987 Richter et al.
4,714,507 A 12/1987 Ohgushi
4,723,866 A 2/1988 McCauley
4,738,070 A 4/1988 Abbott et al.
4,757,662 A 7/1988 Gasser
4,764,069 A 8/1988 Reinwall et al.
4,819,401 A 4/1989 Whitney, Jr.
4,827,684 A 5/1989 Allan
4,830,196 A * 5/1989 Csanady ..... B62H 3/12 211/19
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,887,951 A 12/1989 Hashimoto
4,911,949 A 3/1990 Iwase et al.
4,922,680 A 5/1990 Kramer et al.
4,923,348 A 5/1990 Carlozzo et al.
4,946,632 A 8/1990 Pollina
4,948,319 A 8/1990 Day et al.
4,955,172 A 9/1990 Pierson
4,993,902 A 2/1991 Hellon
5,063,722 A 11/1991 Hohmann
5,099,628 A 3/1992 Noland et al.
5,207,043 A * 5/1993 McGee ..... E04B 1/7616 52/379
5,307,602 A 5/1994 Lebraut
5,338,141 A 8/1994 Hulsey
5,392,581 A 2/1995 Hatzinikolas et al.
5,395,196 A 3/1995 Notaro
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,501,306 A 3/1996 Martino
5,518,351 A 5/1996 Peil
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A * 12/1998 Johnson, III ..... E04B 1/7061 52/302.6
6,000,178 A 12/1999 Goodings
6,045,022 A * 4/2000 Giles ..... B60R 9/06 224/488
6,125,608 A 10/2000 Charlson
6,176,662 B1 1/2001 Champney et al.
6,209,281 B1 4/2001 Rice
6,284,311 B1 9/2001 Gregorovich et al.
6,293,744 B1 9/2001 Hemplfing et al.
6,332,300 B1 12/2001 Wakai
6,351,922 B1 3/2002 Burns et al.
6,367,219 B1 4/2002 Quinlan
6,508,447 B1 1/2003 Catani et al.
6,548,190 B2 4/2003 Spitsberg et al.
6,612,343 B2 9/2003 Camberlin et al.
6,627,128 B1 9/2003 Boyer
6,668,505 B1 12/2003 Hohmann et al.
6,686,301 B2 2/2004 Li et al.
6,709,213 B2 3/2004 Bailey
6,718,774 B2 4/2004 Razzell
6,735,915 B1 5/2004 Johnson, III
6,739,105 B2 5/2004 Fleming
6,812,276 B2 11/2004 Yeager
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,918,218 B2 7/2005 Greenway
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Balbo Di Vinadio
7,152,382 B2 12/2006 Johnson, III

(56) References Cited

U.S. PATENT DOCUMENTS 7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 * 2/2008 Hohmann, Jr. ..... E04B 1/4178 52/167.1
7,334,374 B2 2/2008 Schmid
7,374,825 B2 5/2008 Hazel et al.
7,415,803 B2 8/2008 Bronner
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,654,057 B2 2/2010 Zambelli et al.
7,735,292 B2 6/2010 Massie
7,744,321 B2 6/2010 Wells
7,748,181 B1 7/2010 Guinn
7,788,869 B2 9/2010 Voegele, Jr.
D626,817 S 11/2010 Donowho et al.
7,845,137 B2 12/2010 Hohmann, Jr.
7,918,634 B2 4/2011 Conrad et al.
8,029,223 B2 10/2011 Mair
8,037,653 B2 10/2011 Hohmann, Jr.
8,051,619 B2 11/2011 Hohmann, Jr.
8,092,134 B2 1/2012 Oguri et al.
8,096,090 B1 1/2012 Hohmann, Jr. et al.
8,109,706 B2 * 2/2012 Richards ..... E04B 1/4178 408/227
8,154,859 B2 4/2012 Shahrokhi
8,201,374 B2 6/2012 Hohmann, Jr.
8,209,934 B2 7/2012 Pettingale
8,215,083 B2 7/2012 Toas et al.
8,291,672 B2 10/2012 Hohmann, Jr. et al.
8,347,581 B2 1/2013 Doerr et al.
8,375,667 B2 2/2013 Hohmann, Jr.
8,418,422 B2 4/2013 Johnson, III
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,596,010 B2 12/2013 Hohmann, Jr.
8,609,224 B2 12/2013 Li et al.
8,635,832 B2 1/2014 Heudorfer et al.
8,661,766 B2 3/2014 Hohmann, Jr.
8,726,596 B2 5/2014 Hohmann, Jr.
8,726,597 B2 5/2014 Hohmann, Jr.
8,733,049 B2 5/2014 Hohmann, Jr.
8,739,485 B2 6/2014 Hohmann, Jr.
8,800,241 B2 8/2014 Hohmann, Jr.
8,833,003 B1 9/2014 Hohmann, Jr.
8,839,581 B2 9/2014 Hohmann, Jr.
8,839,587 B2 9/2014 Hohmann, Jr.
8,844,229 B1 9/2014 Hohmann, Jr.
8,881,488 B2 11/2014 Hohmann, Jr. et al.
8,898,980 B2 12/2014 Hohmann, Jr.
8,904,726 B1 12/2014 Hohmann, Jr.
8,904,730 B2 12/2014 Hohmann, Jr.
8,904,731 B2 12/2014 Hohmann, Jr. et al.
8,910,445 B2 12/2014 Hohmann, Jr.
8,920,092 B2 12/2014 D'Addario et al.
8,984,837 B2 3/2015 Curtis et al.
2001/0054270 A1 * 12/2001 Rice ..... E04B 1/4178 52/714
2002/0047488 A1 4/2002 Webb et al.
2002/0100239 A1 8/2002 Lopez
2003/0121226 A1 7/2003 Bolduc
2003/0217521 A1 11/2003 Richardson et al.
2004/0050807 A1 * 3/2004 Cheng ..... B62H 3/12 211/17
2004/0083667 A1 * 5/2004 Johnson, III ..... E04B 2/02 52/379
2004/0187421 A1 9/2004 Johnson, III
2004/0216408 A1 11/2004 Hohmann, Jr.
2004/0216413 A1 11/2004 Hohmann et al.
2004/0216416 A1 11/2004 Hohmann et al.
2004/0231270 A1 11/2004 Collins et al.
2005/0046187 A1 3/2005 Takeuchi et al.
2005/0129485 A1 6/2005 Swim, Jr.
2005/0279042 A1 12/2005 Bronner
2005/0279043 A1 12/2005 Bronner
2006/0198717 A1 9/2006 Fuest
2006/0242921 A1 11/2006 Massie
2006/0251916 A1 11/2006 Arikawa et al.
2007/0011964 A1 1/2007 Smith
2007/0059121 A1 3/2007 Chien
2008/0092472 A1 4/2008 Doerr et al.
2008/0141605 A1 * 6/2008 Hohmann ..... E04B 1/4178 52/408
2008/0166203 A1 7/2008 Reynolds et al.
2008/0222992 A1 9/2008 Hikai et al.
2009/0133351 A1 5/2009 Wobber
2009/0133357 A1 5/2009 Richards
2009/0173828 A1 7/2009 Oguri et al.
2010/0037552 A1 2/2010 Bronner
2010/0071307 A1 3/2010 Hohmann, Jr.
2010/0101175 A1 4/2010 Hohmann
2010/0192495 A1 8/2010 Huff et al.
2010/0257803 A1 10/2010 Hohmann, Jr.
2011/0041442 A1 2/2011 Bui
2011/0047919 A1 * 3/2011 Hohmann, Jr. ..... E04B 1/4178 52/513
2011/0061333 A1 3/2011 Bronner
2011/0083389 A1 4/2011 Bui
2011/0146195 A1 6/2011 Hohmann, Jr.
2011/0164943 A1 7/2011 Conrad et al.
2011/0173902 A1 7/2011 Hohmann, Jr. et al.
2011/0189480 A1 8/2011 Hung
2011/0277397 A1 11/2011 Hohmann, Jr.
2012/0186183 A1 7/2012 Johnson, III
2012/0285111 A1 11/2012 Johnson, III
2012/0304576 A1 12/2012 Hohmann, Jr.
2012/0308330 A1 12/2012 Hohmann, Jr.
2013/0008121 A1 1/2013 Dalen
2013/0074442 A1 3/2013 Hohmann, Jr.
2013/0232893 A1 9/2013 Hohmann, Jr.
2013/0232909 A1 9/2013 Curtis et al.
2013/0247483 A1 9/2013 Hohmann, Jr.
2013/0247484 A1 9/2013 Hohmann, Jr.
2013/0247498 A1 9/2013 Hohmann, Jr.
2013/0340378 A1 12/2013 Hohmann, Jr.
2014/0075855 A1 3/2014 Hohmann, Jr.
2014/0075856 A1 3/2014 Hohmann, Jr.
2014/0075879 A1 3/2014 Hohmann, Jr.
2014/0096466 A1 4/2014 Hohmann, Jr.
2014/0174013 A1 6/2014 Hohmann, Jr. et al.
2014/0202098 A1 7/2014 De Smet et al.
2014/0215958 A1 8/2014 Duyvejonck et al.
2014/0250826 A1 9/2014 Hohmann, Jr.
2015/0033651 A1 2/2015 Hohmann, Jr.
2015/0096243 A1 4/2015 Hohmann, Jr.
2015/0121792 A1 5/2015 Spoo et al.

FOREIGN PATENT DOCUMENTS

GB 1 575 501 9/1980
GB 2 069 024 A 8/1981
GB 2 246 149 A 1/1992
GB 2 265 164 A 9/1993
GB 2459936 B 3/2013

OTHER PUBLICATIONS

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug.

(56) References Cited

OTHER PUBLICATIONS 22, 2008, 11 pages, Boston, MA, United States.
Building Code Requirements for Masonry Structures and Commentary, TMS 402-11/ACI 530-11/ASCE 5-11, 2011, Chapter 6, 12 pages.
Hohmann & Barnard, Inc., Product Catalog, 44 pgs (2003).
Hohmann & Barnard, Inc.; Product Catalog, 2009, 52 pages, Hauppauge, New York, United States.
Hohmann & Barnard, Inc., Product Catalog, 2013, 52 pages, Hauppauge, New York, United States.
Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.
Examination Report for Canadian Application No. 2,844,460, Jan. 12, 2017, 3 pages.

* cited by examiner

THERMALLY COATED WALL ANCHOR AND ANCHORING SYSTEMS WITH IN-CAVITY THERMAL BREAKS FOR CAVITY WALLS

CROSS-REFERENCE TO RELATED APPLICATION

This application is a continuation of U.S. Ser. No. 13/786,982, filed Mar. 6, 2013, now U.S. Pat. No. 9,038,351, issued May 26, 2015, the entire contents of which are incorporated herein by reference.

BACKGROUND OF THE INVENTION

1. Field of the Invention

This invention relates to thermally-coated wall anchors and associated veneer ties and anchoring systems for cavity walls having a masonry inner and outer wythe. More particularly, the invention relates to anchoring systems with thermally-isolating coated wall anchors and associated components made largely of thermally conductive metals. The system has application to seismic-resistant structures and to cavity walls requiring thermal isolation.

2. Description of the Prior Art

The move toward more energy-efficient insulated cavity wall structures has led to the need to create a thermally-isolated building envelope which separates the interior environment and the exterior environment of a cavity wall structure. The building envelope is designed to control temperature, thermal transfer between the wythes and moisture development, while maintaining structural integrity. Thermal insulation is used within the building envelope to maintain temperature and therefore restrict the formation of condensation within the cavity. The integrity of the thermal insulation is compromised when used in conjunction with the prior art metal anchoring systems, which are constructed from thermally conductive metals that facilitate thermal transfer between and through the wythes. The use of the specially designed and thermally-protected wall anchors of the present invention lowers the underlying metal thermal conductivities, thereby reducing thermal transfer.

When a cavity wall is constructed and a thermal envelope created, hundreds, if not thousands, of wall anchors, wall reinforcements and associated ties are inserted throughout the cavity wall. Each anchor and tie combination forms a thermal bridge perforating the insulation and moisture barriers within the cavity wall structure. While seals at the insertion locations deter water and vapor entry, thermal transfer and loss still result. Further, when each individual anchoring system is interconnected veneer-tie-to-wall-anchor, a thermal thread results stretching across the cavity and extending between the inner wythe to the outer wythe. Failure to isolate the steel components and break the thermal transfer, results in heating and cooling losses and potentially damaging condensation buildup within the cavity wall structure. Such buildups provide a medium for corrosion and mold growth. The use of thermally-isolating coated wall anchors removes the thermal bridges and breaks the thermal thread causing a thermally isolated anchoring system with a resulting lower heat loss within the building envelope.

The present invention provides a thermally-isolating coated wall anchor specially-suited for use within a cavity wall having an masonry inner and outer wythe. Anchoring systems within cavity walls are subject to varied outside forces such as earthquakes and wind shear that cause abrupt movement within the cavity wall, requiring high-strength anchoring materials. Additionally, any materials placed within the cavity wall require the characteristics of low flammability and, upon combustion, the release of combustion products with low toxicity. The present invention provides a coating suited to such requirements, which, besides meeting the flammability/toxicity standards, includes characteristics such as shock resistance, non-frangibility, low thermal conductivity and transmissivity, and a non-porous resilient finish. This unique combination of characteristics provides a wall anchor well-suited for installation within a cavity wall anchoring system.

In the past, anchoring systems have taken a variety of configurations. Where the applications included masonry backup walls, wall anchors were commonly incorporated into ladder—or truss-type reinforcements and provided wire-to-wire connections with box-ties or pintle-receiving designs on the veneer side.

In the late 1980's, surface-mounted wall anchors were developed by Hohmann & Barnard, Inc., now a MiTEK-Berkshire Hathaway Company, and patented under U.S. Pat. No. 4,598,518. The invention was commercialized under trademarks DW-10®, DW-10-X®, and DW-10-HS®. These widely accepted building specialty products were designed primarily for dry-wall construction, but were also used with masonry backup walls. For seismic applications, it was common practice to use these wall anchors as part of the DW-10® Seismiclip® interlock system which added a Byna-Tie® wire formative, a Seismiclip® snap-in device—described in U.S. Pat. No. 4,875,319 (319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of more rigorous specifications by which tension and compression characteristics were raised, a different structure—such as one of those described in detail below—became necessary.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud, which include an elongated eye and a wire tie therethrough for deposition in a bed joint of the outer wythe. It is instructive to note that pin-point loading—that is forces concentrated at substantially a single point—developed from this design configuration. This resulted, upon experiencing lateral forces over time, in the loosening of the stud.

There have been significant shifts in public sector building specifications, such as the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe, which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜ inch high space in the inner wythe and tie down a veneer facing material of an outer wythe at a span of two or more times that which had previously been experienced.

As insulation became thicker, the tearing of insulation during installation of the pronged DW-10X® wall anchor, see infra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable.

As concerns for thermal transfer and resulting heat loss/gain and the buildup of condensation within the cavity wall grew, focus turned to thermal isolation and thermal breaks. Another prior art development occurred in an attempt to address thermal transfer shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results. Further reductions in thermal transfer were accomplished through the Byna-Tie® system (319) which provides a bail handle with pointed legs and a dual sealing arrangement as described, U.S. Pat. No. 8,037,653. While each prior art invention reduced thermal transfer, neither development provided more complete thermal protection through the use of a specialized thermally-isolating coated wall anchor, which removes thermal bridging and improves thermal insulation through the use of a thermal barrier.

Focus on the thermal characteristics of cavity wall construction is important to ensuring minimized heat transfer through the walls, both for comfort and for energy efficiency of heating and air conditioning. When the exterior is cold relative to the interior of a heated structure, heat from the interior should be prevented from passing through the outside. Similarly, when the exterior is hot relative to the interior of an air conditioned structure, heat from the exterior should be prevented from passing through to the interior. The main cause of thermal transfer is the use of anchoring systems made largely of metal wire formatives, or metal plate components, that are thermally conductive. While providing the required high-strength within the cavity wall system, the use of steel components results in heat transfer.

Another application for anchoring systems is in the evolving technology of self-cooling buildings. Here, the cavity wall serves additionally as a plenum for delivering air from one area to another. The ability to size cavities to match air moving requirements for naturally ventilated buildings enable the architectural engineer to now consider cavity walls when designing structures in this environmentally favorable form.

Building thermal stability within a cavity wall system requires the ability to hold the internal temperature of the cavity wall within a certain interval. This ability helps to prevent the development of cold spots, which act as gathering points for condensation. Through the use of a thermally-isolating coating, the underlying steel wall anchor obtains a lower transmission (U-value) and thermal conductive value (K-value) and provides non-corrosive benefits. The present invention maintains the strength of the steel and further provides the benefits of a thermal break in the cavity.

In the past, the use of wire formatives have been limited by the mortar layer thicknesses which, in turn are dictated either by the new building specifications or by pre-existing conditions, e.g., matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. This led to the low-profile wall anchors of the inventors hereof as described in U.S. Pat. No. 6,279,283. The combination of each individual wall anchor and tie combination linked together in a cavity wall setting creates a thermal thread throughout the structure thereby raising thermal conductivity and reducing the effectiveness of the insulation. The present invention provides a thermal break which interrupts and restricts thermal transfer.

In the course of preparing this application, several patents, became known to the inventors hereof and are acknowledged hereby:

| Patent | Inventor | Issue Date |
|---|---|---|
| 2,058,148 | Hard | October, 1936 |
| 2,966,705 | Massey | January, 1961 |
| 3,377,764 | Storch | April, 1968 |
| 4,021,990 | Schwalberg | May, 1977 |
| 4,305,239 | Geraghty | December, 1981 |
| 4,373,314 | Allan | February, 1983 |
| 4,438,611 | Bryant | March, 1984 |
| 4,473,984 | Lopez | October, 1984 |
| 4,598,518 | Hohmann | July, 1986 |
| 4,869,038 | Catani | September, 1989 |
| 4,875,319 | Hohmann | October, 1989 |
| 5,063,722 | Hohmann | November. 1991 |
| 5,392,581 | Hatzinikolas et al. | February, 1995 |
| 5,408,798 | Hohmann | April, 1995 |
| 5,456,052 | Anderson et al. | October, 1995 |
| 5,816,008 | Hohmann | October, 1998 |
| 6,125,608 | Charlson | October, 2000 |
| 6,209,281 | Rice | April, 2001 |
| 6,279,283 | Hohmann et al. | August, 2001 |
| 8,109,706 | Richards | February, 2012 |
| | Foreign Patent Documents | |
| 279209 | CH | March, 1952 |
| 2069024 | GB | August, 1981 |

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—Schwalber—Issued May 10, 1977

Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—Catani—Issued Sep. 26, 1989

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,875,319—Hohmann—Issued Sep. 24, 1989

Discloses a seismic construction system for anchoring a facing veneer to wallboard/metal stud construction with a pronged sheetmetal anchor. The wall tie is distinguished over that of Schwalberg '990 and is clipped onto a straight wire run.

U.S. Pat. No. 5,392,581—Hatzinikolas et al.—Issued Feb. 28, 1995

Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995

Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995

Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Sep. 15, 1998

Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,125,608—Charlson—Issued Sep. 3, 2000

Discloses a composite insulated framing system within a structural building system. The Charlson system includes an insulator adhered to the structural support through the use of adhesives, frictional forces or mechanical fasteners to disrupt thermal activity.

U.S. Pat. No. 6,209,281—Rice—Issued Apr. 3, 2001

Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001

Discloses a low-profile wall tie primarily for use in renovation construction where in order to match existing mortar height in the facing wythe a compressed wall tie is embedded in the bed joint of the brick veneer.

U.S. Pat. No. 8,109,706—Richards—Issued Feb. 7, 2012

Discloses a composite fastener, belly nut and tie system for use in a building envelope. The composite fastener includes a fiber reinforced polymer. The fastener has a low thermal conductive value and non-corrosive properties.

None of the prior art listed above provide a thermally-isolating coated anchoring system that maintains the thermal isolation of a building envelope. As will become clear in reviewing the disclosure which follows, the cavity wall structures benefit from the recent developments described herein that lead to solving the problems of thermal insulation and heat transfer within the cavity wall. The wall anchor assembly is modifiable for use on various style wall anchors allowing for interconnection with veneer ties in varied cavity wall structures. The prior art does not provide the present novel cavity wall construction system as described herein below.

SUMMARY

In general terms, the invention disclosed hereby is a high-strength thermally-isolating wire formative anchoring system for use in a masonry cavity wall structure. The wall anchor is thermally-coated and interconnected with varied veneer ties. The veneer ties are wire formatives configured for insertion within the wall anchor and the bed joints of the outer wythe. The veneer ties are optionally compressed forming a low profile construct and swaged for interconnection with a reinforcement wire to form a seismic construct.

The thermally-isolated wall anchor and anchoring system is a wire formative device with varied veneer tie receptor portions for interconnection with a veneer tie. The wall anchor provides a thermal break in the cavity wall structure through the use of a novel thermally-isolating coating. The veneer tie receptor portion and optionally, the leg portions and the rear leg receive a thermally-isolating coating. The thermally-isolating coating is selected from a distinct grouping of materials, which are applied using a specific variety of methods, in one or more layers which are cured and cross-linked to provide high-strength adhesion. A matte finish is provided to form a high-strength interconnection. The thermally-coated wall anchors provide an in-cavity thermal break that interrupts the thermal conduction in the anchoring system threads running throughout the cavity wall structure. The thermal coating reduces the U- and K-values of the anchoring system by thermally-isolating the metal components.

The thermally-isolated anchoring system includes a wire formative wall anchor affixed to a wall reinforcement. A veneer tie with an optional reinforcement wire is interengaged with the wall anchor and mounted within the outer wythe. The veneer tie is a pintle device and when interconnected with the wall anchor restricts movement and veneer tie pullout.

It is an object of the present invention to provide new and novel anchoring systems for cavity walls, which systems are thermally isolating.

It is another object of the present invention to provide a new and novel high-strength metal wall anchor which is thermally coated with a thermally-isolating compound that reduces the U- and K-values of the anchoring system.

It is yet another object of the present invention to provide in an anchoring system having an inner wythe and an outer wythe, a high-strength wall anchor that interengages a veneer tie.

It is still yet another object of the present invention to provide an anchoring system which is constructed to maintain insulation integrity within the building envelope by providing a thermal break.

It is a feature of the present invention that the wall anchor hereof provides thermal isolation of the anchoring system.

It is another feature of the present invention that the wall anchor is utilizable with a masonry wall reinforcement construct that is secured within the bed joints of the inner wythe and is interconnected with a veneer tie.

It is another feature of the present invention that the thermally-coated wall anchor provides an in-cavity thermal break.

It is a further feature of the present invention that the wall anchor coating is shock resistant, resilient and noncombustible.

Other objects and features of the invention will become apparent upon review of the drawings and the detailed description which follows.

BRIEF DESCRIPTION OF THE DRAWINGS

In the following drawings, the same parts in the various views are afforded the same reference designators.

DESCRIPTION OF THE PREFERRED EMBODIMENTS

Figure 1:
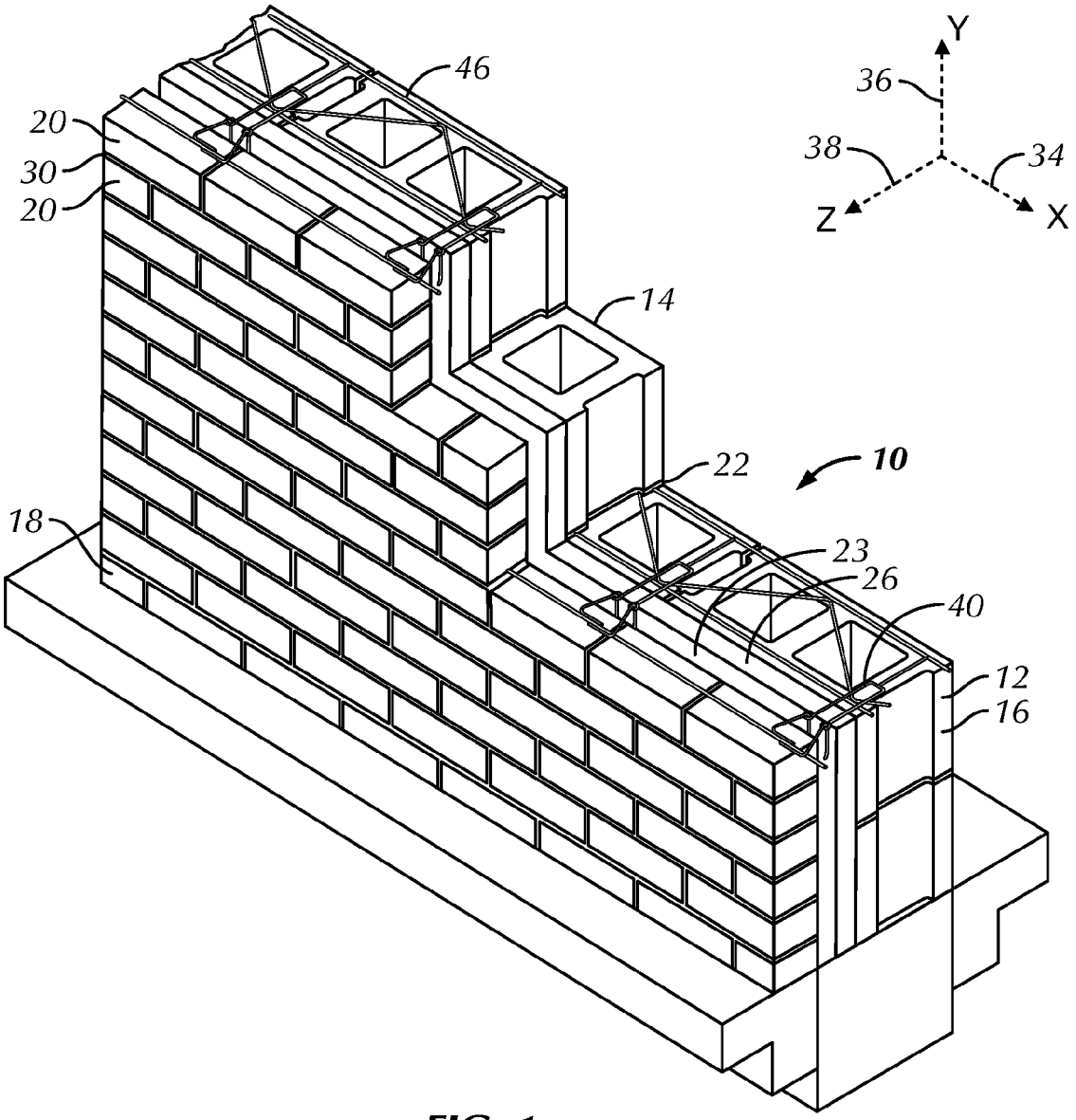
FIG. 1 shows a perspective view of this invention with an anchoring system having a thermally isolating wall anchor, as applied to a cavity wall with an inner wythe of masonry construction with insulation disposed on the cavity-side thereof and an outer wythe of brick interconnected with a veneer tie and a reinforcement wire.

Before entering into the detailed Description of the Preferred Embodiments, several terms which will be revisited later are defined. These terms are relevant to discussions of innovations introduced by the improvements of this disclosure that overcome the technical shortcoming of the prior art devices.

In the embodiments described hereinbelow, the inner wythe is optionally provided with insulation and/or a waterproofing membrane. In the cavity wall construction shown in the embodiments hereof, this takes the form of exterior insulation disposed on the outer surface of the inner wythe. Recently, building codes have required that after the anchoring system is installed and, prior to the inner wythe being closed up, that an inspection be made for insulation integrity to ensure that the insulation prevents infiltration of air and moisture. Here the term insulation integrity is used in the same sense as the building code in that, after the installation of the anchoring system, there is no change or interference with the insulative properties and concomitantly substantially no change in the air and moisture infiltration characteristics.

In a related sense, prior art wire formative anchors and anchoring systems have formed a conductive bridge between the wall cavity and the interior of the building. Here the terms thermal conductivity and thermal conductivity analysis are used to examine this phenomenon and the metal-to-metal contacts across the inner wythe. The present anchoring system serves to sever the conductive bridge and interrupt the thermal pathway created throughout the cavity wall by the metal components, including a reinforcement wire which provides a seismic structure. Failure to isolate the metal components of the anchoring system and break the thermal transfer, results in heating and cooling losses and in potentially damaging condensation buildup within the cavity wall structure.

In the detailed description, the wall anchor and reinforcement and the veneer ties and reinforcement wires are wire formatives. The wire used in the fabrication of veneer joint reinforcement conforms to the requirements of ASTM Standard Specification A951-00, Table 1. For the purpose of this application tensile strength tests and yield tests of veneer joint reinforcements are, where applicable, those denominated in ASTM A-951-00 Standard Specification for Masonry Joint Reinforcement.

The thermal stability within the cavity wall maintains the internal temperature of the cavity wall within a certain interval. Through the use of the presently described thermally-isolating coating, the underlying metal wire formative wall anchor, obtains a lower transmission (U-value) and thermal conductive value (K-value), providing a high strength anchor with the benefits of thermal isolation. The term K-value is used to describe the measure of heat conductivity of a particular material, i.e., the measure of the amount of heat, in BTUs per hour, that will be transmitted through one square foot of material that is one inch thick to cause a temperature change of one degree Fahrenheit from one side of the material to the other. The lower the K-value, the better the performance of the material as an insulator. The metal wire comprising the components of the anchoring systems generally have a K-value range of 16 to 116 W/m K. The thermal coating disposed on the wall anchor of this invention greatly reduces such K-values to a low thermal conductive (K-value) not to exceed 1 W/m K. Similar to the K-value, a low thermal transmission value (U-value) is important to the thermal integrity of the cavity wall. The term U-value is used to describe a measure of heat loss in a building component. It can also be referred to as an overall heat transfer co-efficient and measures how well parts of a building transfer heat. The higher the U-value, the worse the thermal performance of the building envelope. Low thermal transmission or U-value is defined as not to exceed 0.35 $W/m^2K$ for walls. The U-value is calculated from the reciprocal of the combined thermal resistances of the materials in the cavity wall, taking into account the effect of thermal bridges, air gaps and fixings.

Referring now to FIGS. 1 through 7, the present invention shows an anchoring system with a thermally isolating wall anchor that provides an in-cavity thermal break. This system is suitable for recently promulgated standards and, in addition, has lower thermal transmission and conductivity values than the prior art anchoring systems. The system discussed in detail hereinbelow, has a thermally-isolating wall anchor and reinforcement device with a veneer tie receptor portion for interengagement with a veneer tie. The reinforcement device is mounted in the bed joint of the inner wythe. Where insulation is shown on the (FIG. 1), a cavity wall having an insulative layer of 2.5 inches (approx.) and a total span of 3.5 inches (approx.) is chosen as exemplary.

The thermally-isolating anchoring system for cavity walls is referred to generally by the numeral 10. A cavity wall structure 12 is shown having an inner wythe or backup wall 14 of successive courses of masonry block 16 with mortar-filled bed joints 22 of a predetermined height between each adjacent course 16 and an outer wythe or facing wall 18 of brick 20 construction. Between the inner wythe 14 and the outer wythe 18, a cavity 23 is formed. The inner wythe 14 has optional attached insulation 26.

Figure 2:
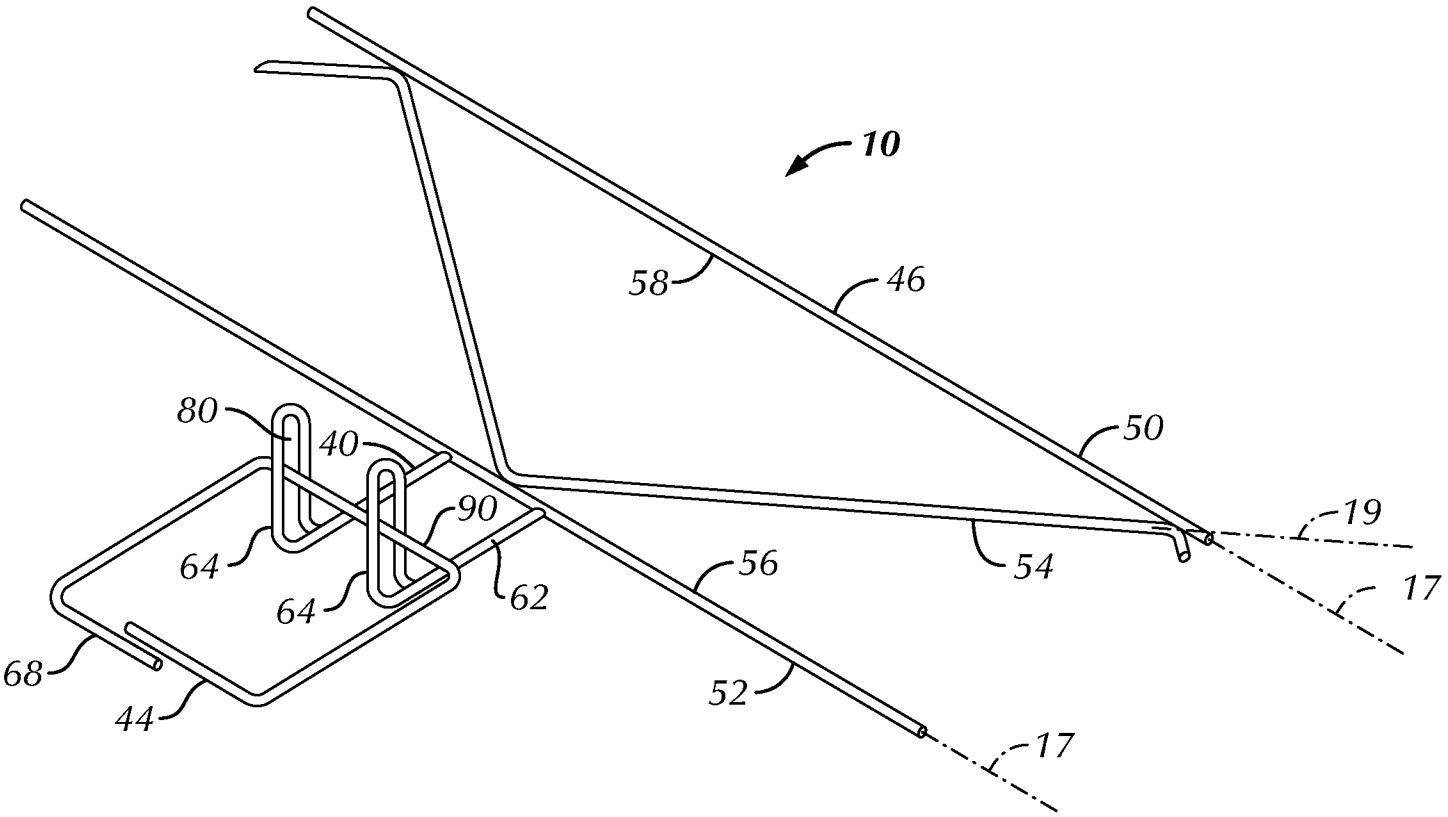
FIG. 2 is a perspective view of an alternative anchoring system with a truss reinforcement with an anchor without a rear leg interconnected with a veneer tie.
Figure 3:
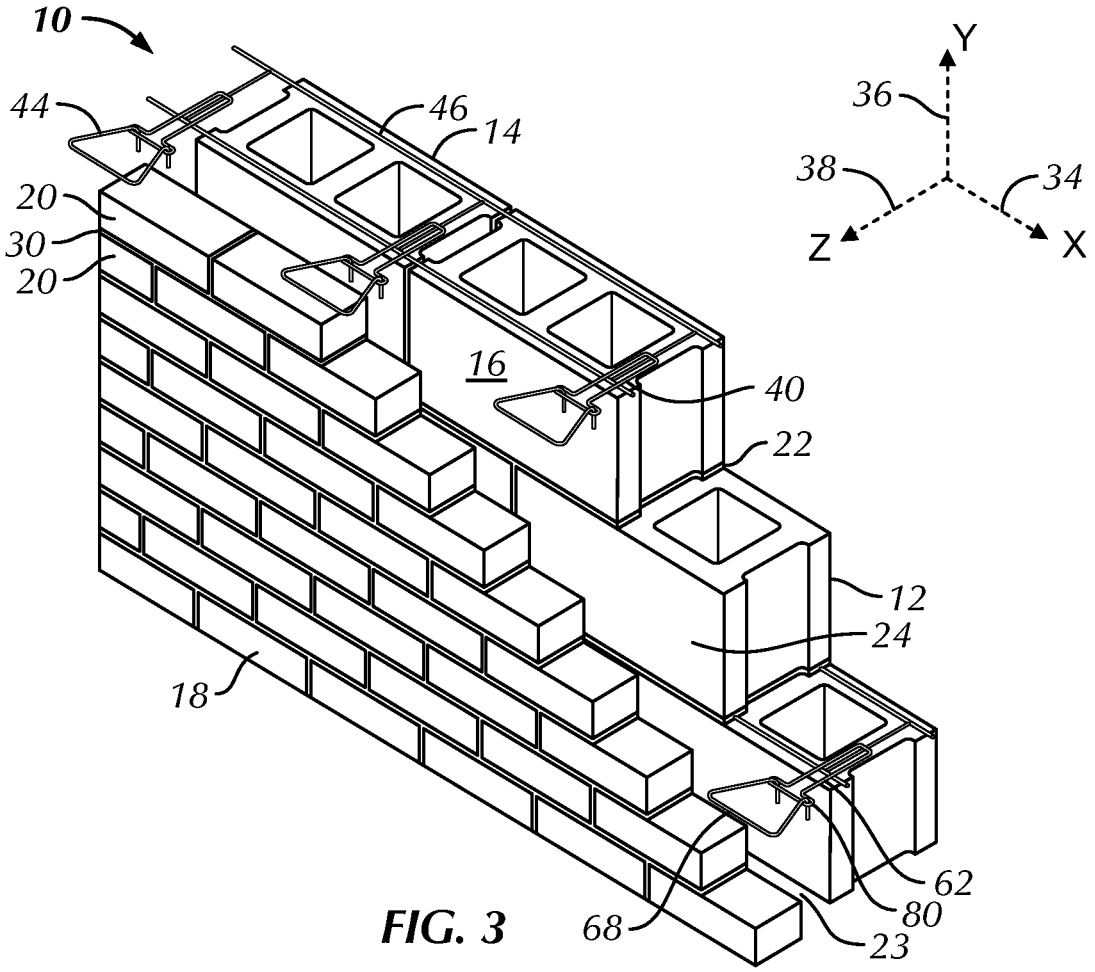
FIG. 3 is a perspective view of another alternative design thermally-isolating anchoring system interconnected with a veneer tie set on a masonry cavity wall.
Figure 4:
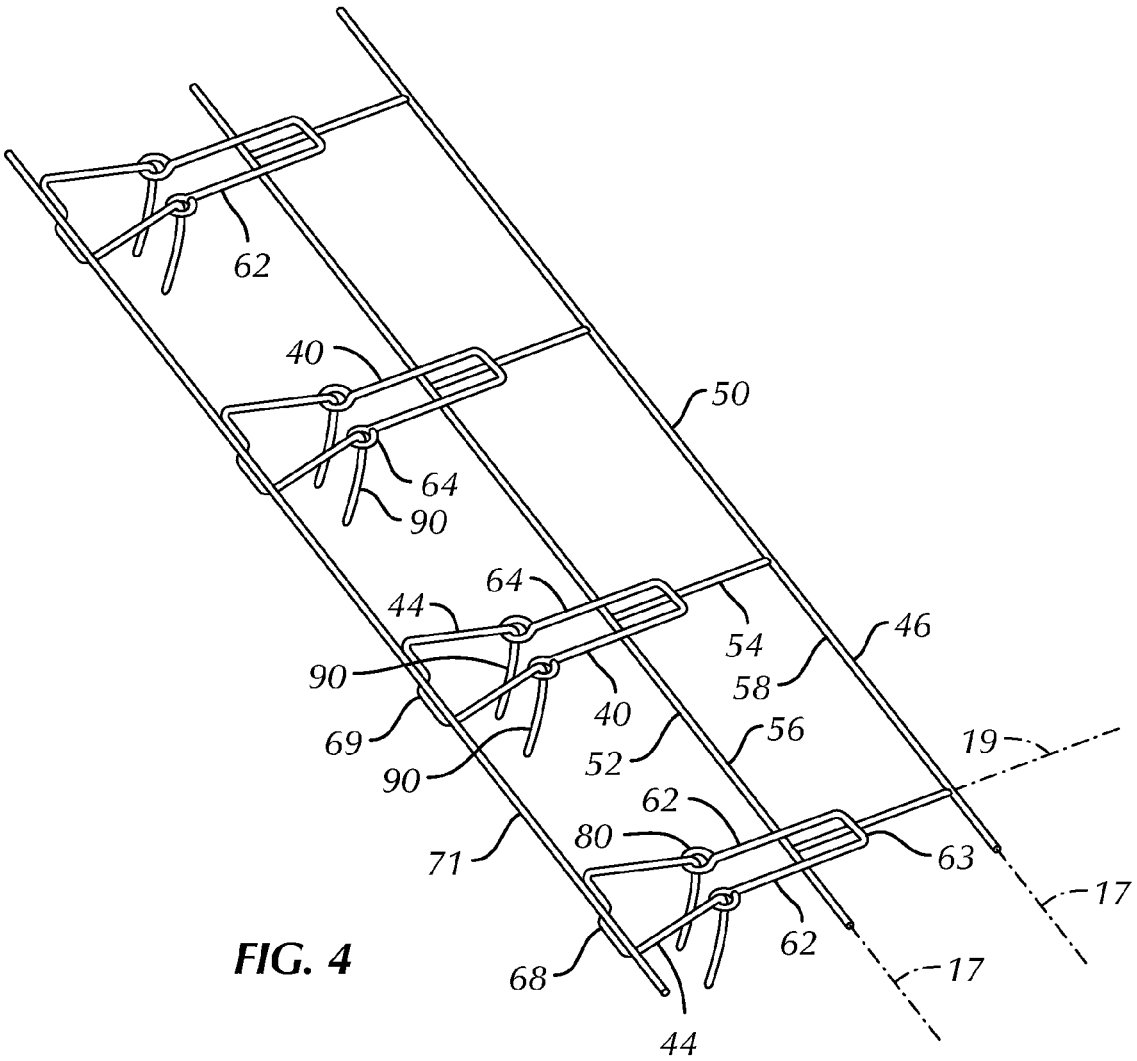
FIG. 4 is a perspective view of another alternative design thermally-isolating wall anchoring system for emplacement within a cavity wall, the anchoring system is interconnected with a veneer tie and reinforcement wire.

Successive bed joints 30 in the outer wythe 18 and bed joints 22 in the inner wythe 14 are substantially planar and horizontally disposed and in accord with building standards are a predetermined 0.375-inch (approx.) in height. Selective ones of bed joints 30, which are formed between courses of bricks 20, are constructed to receive therewithin the insertion portion 68 of the veneer tie 44 of the anchoring system hereof. Selective ones of bed joints 22, which are formed between courses of masonry block 16, are constructed to receive therewithin the wall reinforcement 46 of the anchoring system hereof. The wall reinforcement 46 is constructed from a pair of side wires 50, 52 disposed parallel to each other. The pair of side wires 50, 52 each have a longitudinal axis 17. Intermediate wires 54 are affixed to the interior sides 56, 58 of the side wires 50, 52 configuring the wall reinforcement 46 in either a truss (FIGS. 1 and 2) or a ladder formation (FIGS. 3 and 4). The intermediate wires 54 have longitudinal axes 19 and when the wall reinforcement 46 is mounted within the inner wythe 14, the longitudinal axes 17 and 19 are disposed in a substantially horizontal plane.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes. As shown in FIG. 1, thermally-isolating wall anchors 40 are constructed from a wire formative. Alternative design wall anchors 40 are shown in FIGS. 2 and 3. The wall anchor 40 is fusibly attached to the wall reinforcement 46 either along the side wire 50 or on the side wire 50 and intermediate wires 54. The wall anchor 40 has leg portions 62, which are optionally interconnected by a rear leg 63, that extend toward and into the cavity 23. A veneer tie receptor portion 64 is contiguous with the leg portion 62 and configured to interengage a veneer tie 44. The veneer tie receptor portion takes varied forms and is shown as an eyelet 80 with a predetermined diameter to interengages with the veneer tie 44 interengaging end portion 90 in FIGS. 1, 4, and 5 and an elongated eyelet in FIGS. 2 and 6. The eyelet 80 is optionally welded closed. A further variation is of the wall anchor 40 shown in FIG. 3. This variation has a single eyelet 80 that interconnects the leg portions 62 per QS.

Figure 5:
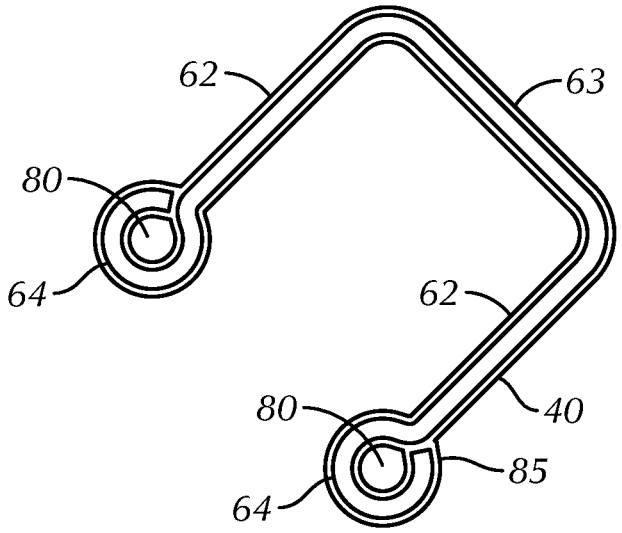
FIG. 5 is a perspective view of a cross-section of the thermally-isolating wall anchor of FIG. 4 showing the wire formative wall anchor with the thermally-isolating coating applied thereon.
Figure 6:
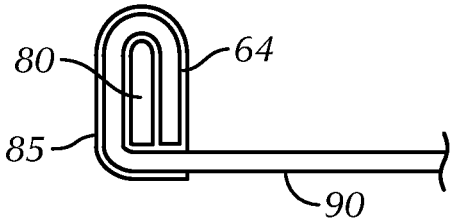
FIG. 6 is a side view of a cross-section of the thermally-isolating wall anchor of FIG. 2 showing the wire formative wall anchor with the thermally-isolating coating applied to the veneer tie receptor portion; and, FIG. 7 is a cross-sectional view of the leg portion of the wall anchor of FIG. 5 with the thermally-isolating coating applied thereon.
Figure 7:
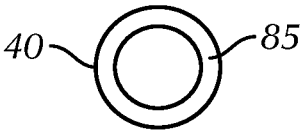

A thermally-isolating coating or thermal coating 85 is applied to the veneer tie receptor portion 64 (as shown in FIG. 6) to provide a thermal break in the cavity. The thermal coating 85 is optionally applied to the leg portions 62 and the rear leg 63 (as shown in FIG. 5) to provide ease of coating and additional thermal protection. The thermal coating 85 is selected from thermoplastics, thermosets, natural fibers, rubbers, resins, asphalts, ethylene propylene diene monomers, and admixtures thereof and applied in layers. The thermal coating 85 optionally contains an isotropic polymer which includes, but is not limited to, acrylics, nylons, epoxies, silicones, polyesters, polyvinyl chlorides, and chlorosulfonated polyethelenes. The initial layer of the thermal coating 85 is cured to provide a precoat and the layers of the thermal coating 85 are cross-linked to provide high-strength adhesion to the veneer tie to resist chipping or wearing of the thermal coating 85.

The thermal coating 85 reduces the K-value and the U-value of the underlying metal components which include, but are not limited to, mill galvanized, hot galvanized, and stainless steel. Such components have K-values that range from 16 to 116 W/m K. The thermal coating 85 reduces the K-value of the veneer tie 44 to not exceed 1.0 W/m K and the associated U-value to not exceed 0.35 $W/m^2K$. The thermal coating 85 is not combustible and gives off no toxic smoke in the event of a fire. Additionally, the thermal coating 85 provides corrosion protection which protects against deterioration of the anchoring system 10 over time.

The thermal coating 85 is applied through any number of methods including fluidized bed production, thermal spraying, hot dip processing, heat-assisted fluid coating, or extrusion, and includes both powder and fluid coating to form a reasonably uniform coating. A coating 85 having a thickness of at least about 5 micrometers is optimally applied. The thermal coating 85 is applied in layers in a manner that provides strong adhesion to the wall anchor 40. The thermal coating 85 is cured to achieve good cross-linking of the layers. Appropriate examples of the nature of the coating and application process are set forth in U.S. Pat. Nos. 6,284,311 and 6,612,343.

The veneer tie 44 is a wire formative generally with a pintle design and shown in FIGS. 1 and 3 as being emplaced on a course of bricks 20 in preparation for embedment in the mortar of bed joint 30. The thermally-isolating anchoring system 10 includes a wall anchor 40, a reinforcement device 46, a veneer tie 44, and optionally a reinforcement wire 71.

The dimensional relationship between wall anchor 40 and veneer tie 44 limits the axial movement of the construct. The veneer tie 44 is a wire formative. Each veneer tie 44 has an interengaging end portion 90 which is in close fitting functional relationship with the diameter of the veneer tie receptor portion 64 and an insertion portion 68 for insertion within the outer wythe 14. The veneer tie receptor portion 64 is constructed, in accordance with the building code requirements, to be within the predetermined dimensions to limit the z-axis 38 movement and permit y-axis 36 adjustment of the veneer tie 44. The dimensional relationship of the interengaging end portion 80 to the veneer tie receptor portion 64 limits the x-axis movement of the construct.

The insertion portion 68 is optionally (FIG. 3) compressively reduced in height to a combined height substantially less than the predetermined height of the bed joint 30 ensuring a secure hold in the bed joint 30 and an increase in the strength and pullout resistance of the veneer tie 44. Further to provide for a seismic construct, an optional compression or swaged indentation 69 is provided in the insertion portion 68 to interlock in a snap-fit relationship with a reinforcement wire 71 (as shown in FIG. 4).

As shown in the description and drawings, the present invention serves to thermally isolate the components of the anchoring system reducing the thermal transmission and conductivity values of the anchoring system to low levels. The novel coating provides an insulating effect that is high-strength and provides an in-cavity thermal break, severing the thermal threads created from the interlocking anchoring system components.

In the above description of the anchoring systems of this invention various configurations are described and applications thereof in corresponding anchoring systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A wall anchor for use in a cavity wall having an outer wythe and an inner wythe in a spaced apart relationship and forming a cavity therebetween, the wall anchor comprising:

one or more leg portions configured to extend into the cavity and formed from wire formative;

a veneer tie receptor portion contiguous with the one or more leg portions, the veneer tie receptor portion formed from wire formative and configured to engage a veneer tie mounted in the outer wythe; and a thermally-isolating coating disposed on the veneer tie receptor portion and retained with the veneer tie receptor portion prior to installation of the wall anchor in the cavity wall, the coating being selected to have low thermal conductivity and transmissivity, the coating forming a thermal break in the cavity;

wherein upon installation in the cavity wall, the wall anchor restricts thermal transfer between the veneer tie and the wall anchor and between the wall anchor and the veneer tie.

2. The wall anchor of claim 1, wherein the veneer tie receptor portion and the one or more leg portions are made from mill galvanized, hot galvanized, or stainless steel.

3. The wall anchor of claim 2, wherein the one or more leg portions is free from thermal coating.

4. The wall anchor of claim 2, wherein the thermally-isolating coating is disposed on only the veneer tie receptor portion.

5. The wall anchor of claim 2, wherein the thermally-isolating coating is disposed on the one or more leg portions.

6. The wall anchor of claim 2, wherein the veneer tie receptor portion comprises an eyelet defined by an interior surface of the receptor portion, the thermally-isolating coating being disposed on the interior surface defining the eyelet.

7. The wall anchor of claim 6, wherein at least parts of the interior surface of the receptor portion are in opposed relation with each other.

8. The wall anchor of claim 6, wherein the wall anchor comprises two leg portions extending into the cavity and the veneer tie receptor portion eyelet interconnects the two leg portions.

9. The wall anchor of claim 1, wherein the one or more leg portions is free from thermal coating.

10. The wall anchor of claim 1, wherein the thermally-isolating coating is disposed on only the veneer tie receptor portion.

11. The wall anchor of claim 1, wherein the thermally-isolating coating is disposed on the one or more leg portions.

12. The wall anchor of claim 1, wherein said one or more leg portions comprises two leg portions extending into the cavity and a rear leg extending between the two leg portions.

13. The wall anchor of claim 12, wherein the thermally-isolating coating is further applied to the leg portions and the rear leg.

14. The wall anchor of claim 1, wherein the veneer tie receptor portion comprises an eyelet defined by an interior surface of the receptor portion, the thermally-isolating coating being disposed on the interior surface defining the eyelet.

15. The wall anchor of claim 14, wherein the wall anchor comprises two leg portions extending into the cavity and the veneer tie receptor portion eyelet interconnects the two leg portions.

16. The wall anchor of claim 1, wherein the thermally-isolating coating is one or more layers of a compound selected from the group consisting of thermoplastics, thermosets, natural fibers, rubbers, resins, asphalts, ethylene propylene diene monomers, and admixtures thereof.

17. The wall anchor of claim 16, wherein the selected compound is an isotropic polymer selected from the group consisting of acrylics, nylons, epoxies, silicones, polyesters, polyvinyl chlorides, and chlorosulfonated polyethylenes.

18. The wall anchor of claim 16, wherein the thermally-isolating coating includes a prime coat; and wherein outer layers of the thermally-isolating coating are cross-linked to the prime coat to provide high-strength adhesion to the wall anchor cavity portion.

19. The wall anchor of claim 16, wherein the thermally-isolating coating reduces the K-value of the wall anchor to a level not to exceed 1.0 $W/m^2K$.

20. The wall anchor of claim 16, wherein the thermally-isolating coating reduces the U-value of the wall anchor to a level not to exceed 0.35 $W/m^2K$.

* * * * *